US011891757B2

(12) United States Patent
Bazzano

(10) Patent No.: US 11,891,757 B2
(45) Date of Patent: Feb. 6, 2024

(54) PROCESS FOR DYEING ANIMAL TEXTILE FIBERS COMPRISING THE USE OF PURIFIED SYNTHETIC FOOD DYES

(71) Applicant: VEBACHEM S.R.L.S., Cossato (IT)

(72) Inventor: Nerio Bazzano, Cossato (IT)

(73) Assignee: Vebachem S.R.L.S., Cossato (IT)

( * ) Notice: Subject to any disclaimer, the term of this patent is extended or adjusted under 35 U.S.C. 154(b) by 239 days.

(21) Appl. No.: 17/620,430

(22) PCT Filed: Jun. 17, 2020

(86) PCT No.: PCT/IB2020/055645

§ 371 (c)(1),
(2) Date: Dec. 17, 2021

(87) PCT Pub. No.: WO2020/254979

PCT Pub. Date: Dec. 24, 2020

(65) Prior Publication Data

US 2022/0349121 A1 Nov. 3, 2022

(30) Foreign Application Priority Data

Jun. 18, 2019 (IT) ..... 102019000009348

(51) Int. Cl.
*D06P 3/00* (2006.01)
*D06P 3/14* (2006.01)
(Continued)

(52) U.S. Cl.
CPC ..... *D06P 3/141* (2013.01); *D06P 3/16* (2013.01); *D06P 5/02* (2013.01); *D06P 1/6133* (2013.01);
(Continued)

(58) Field of Classification Search
CPC .... D06P 3/141; D06P 3/16; D06P 5/02; D06P 1/6133; D06P 1/645; D06P 1/65118; D06P 1/65175; D06P 1/6533; D06P 1/6536; D06P 1/66; D06P 1/67383; D06P 1/34; D06P 1/39; D06P 1/623; D06P 1/649;
(Continued)

(56) References Cited

FOREIGN PATENT DOCUMENTS

CN 106012589 A * 10/2016 ..... D06P 3/14
CN 106012589 B 11/2018

OTHER PUBLICATIONS

Jocic et al. (2005) "Effect of Low-Temperature Plasma and Chitosan Treatment on Wool Dyeing with Acid Red 27", Journal of Applied Polymer Science, John Wiley & Sons, Inc., vol. 97, No. 6, pp. 2204-2214.

(Continued)

*Primary Examiner* — Eisa B Elhilo
(74) *Attorney, Agent, or Firm* — Lathrop GPM LLP; Wm. Tucker Griffith

(57) ABSTRACT

A textile dyeing process is described for dyeing a textile material, product or article consisting of animal fibers, comprising the steps of dipping said textile material, product or article into a dyeing bath comprising at least one detergent substance, a wetting substance, a leveling substance and an acidity regulator; adding to the dyeing bath a coloring substance approved for food use; subjecting the dyed textile material, product or article to washes; and finally subjecting the dyed textile material, product or article to a color fixing treatment.

8 Claims, 1 Drawing Sheet

(51) Int. Cl.

| | |
|---|---|
| ***D06P 3/16*** | (2006.01) |
| ***D06P 5/02*** | (2006.01) |
| *D06P 1/613* | (2006.01) |
| *D06P 1/645* | (2006.01) |
| *D06P 1/651* | (2006.01) |
| *D06P 1/653* | (2006.01) |
| *D06P 1/66* | (2006.01) |
| *D06P 1/673* | (2006.01) |

(52) U.S. Cl.
CPC ..... *D06P 1/645* (2013.01); *D06P 1/6533* (2013.01); *D06P 1/6536* (2013.01); *D06P 1/65118* (2013.01); *D06P 1/65175* (2013.01); *D06P 1/66* (2013.01); *D06P 1/67383* (2013.01)

(58) Field of Classification Search
CPC ..... D06P 1/65131; D06P 1/653; D06P 1/655; D06P 1/0032
USPC ..... 8/550, 551
See application file for complete search history.

(56) References Cited

OTHER PUBLICATIONS

Database WPI Week 201783 (2017), Thomson Scientific, London, GB; TR 201603418 A (Penti Corap Sanayi Ve Ticaret As) Oct. 23, 2017, abstract.
International Search Report and Written Opinion corresponding to International Patent Application No. PCT/IB2020/055645 dated Oct. 12, 2020.

* cited by examiner

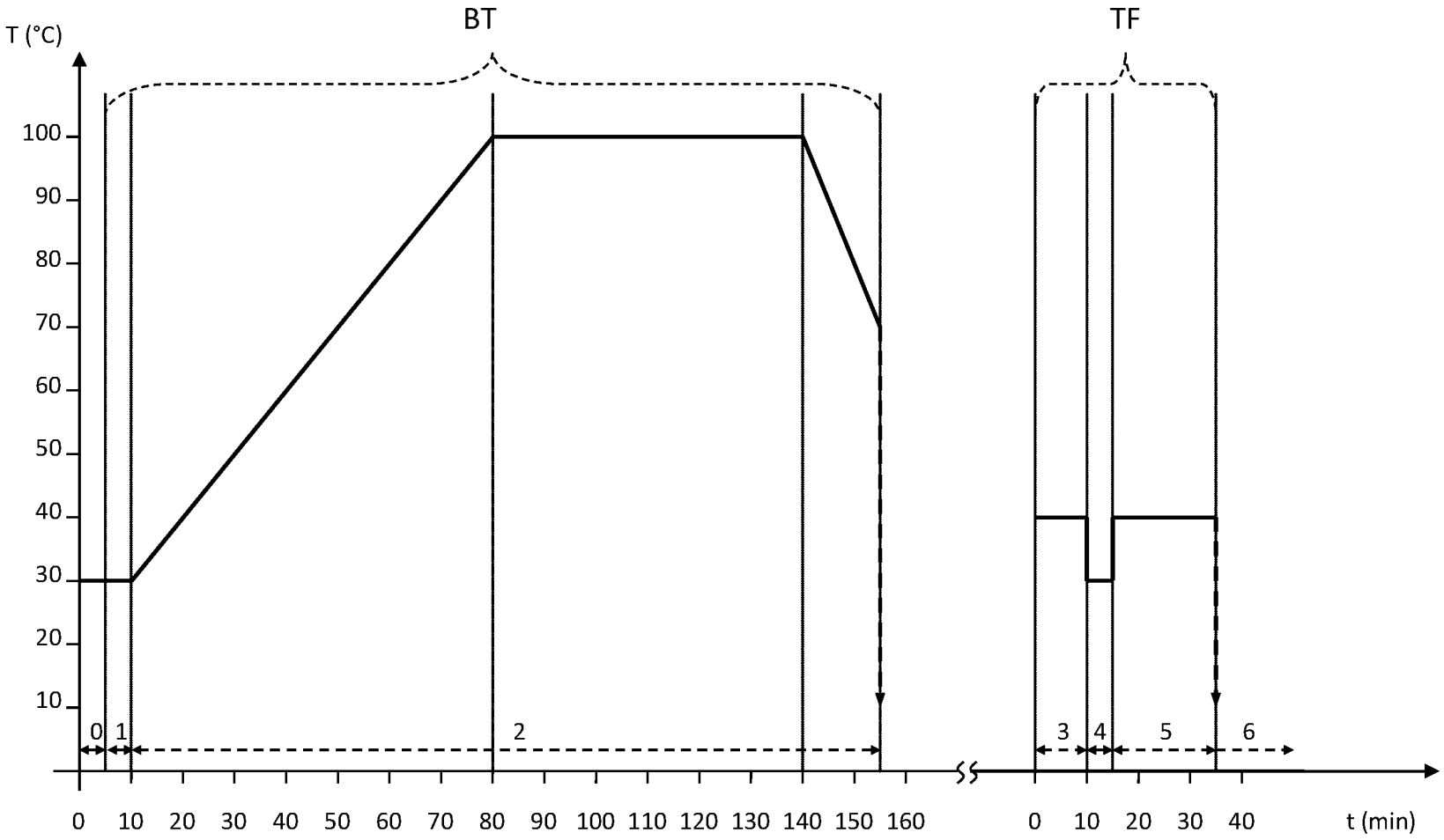
T (°C)
100
90
80
70
60
50
40
30
20
10
BT
TF
0
1
2
3
4
5
6
0
10
20
30
40
50
60
70
80
90
100
110
120
130
140
150
160
0
10
20
30
40
t (min)

PROCESS FOR DYEING ANIMAL TEXTILE FIBERS COMPRISING THE USE OF PURIFIED SYNTHETIC FOOD DYES

RELATED APPLICATIONS

This application is a 35 U.S.C. § 371 filing of International Patent Application No. PCT/IB2020/055645, filed Jun. 17, 2020, which claims the right of priority to Italian Patent Application No. 102019000009348, filed Jun. 18, 2019, the complete contents of which are incorporated by reference herein in their entireties.

FIELD OF THE INVENTION

The present invention relates in general to the sector of the methods and processes for the treatment of textile products and/or articles, and more particularly to a textile process for dyeing fibers and fabrics consisting of animal hair, in particular for dyeing wool, wherein purified synthetic dyes already used in the food and pharmaceutical industries are used.

STATE OF THE ART

The dyeing of yarns and textile articles in general is a practice with very ancient origins. The number of processes developed for the purpose of dyeing fabrics is very high, and the details of each process depend on the type of yarn, on the dye, and also on the geographical area in the case of processes typical of local traditions.

Textile fibers are essentially of two types, natural and synthetic fibers; natural fibers can in turn be subdivided into vegetable (cotton, linen, hemp, . . . ) and animal fibers (mainly wool and silk). The types of dyeing processes that can be applied, the stage of production of the fabric in which dyeing can be carried out, and also the obtained results, vary depending on the type of fiber, and in particular the chemical composition of the same.

For example, synthetic fibers can be mass dyed, i.e. already in the stage in which the material (polyester, polyamide, polyacrylate, . . . ) is still a molten mass, ahead of the production of the fibers; this procedure gives rise to the most resistant coloring, but obviously it is not applicable to natural fibers, which can be dyed for example "in loose fibers" (that is, at the level of free fibers, before twisting), "in the yarn" (on the already spun fibers) or "in the piece" (on the final fabric).

Vegetable fibers are essentially made up of cellulose, which is almost pure in cotton and mixed with components such as lignin and pectin in other fibers. The coloring of cellulose fibers is relatively simple, in particular when the fibers (free or already woven) are subjected to the preparatory process known as "mercerization", which consists of treating the fibers with a caustic solution (sodium carbonate or, more commonly, sodium hydroxide).

The mercerization treatment is instead not possible in the case of animal fibers, in particular wool that, if subjected to this treatment, would undergo the effect known as felting, with degradation of its functional and aesthetic qualities. Among animal fibers, wool still continues to be widely used and to present itself as an unsurpassed fiber in terms of characteristics and performance for creating a wide range of textile products and articles. These fibers, unlike the vegetable ones, are protein-based, and are in general more difficult to color than the vegetable ones; in particular, on these fibers it is more difficult to obtain a high color resistance to washing or exposure to light; the resistance of the color on the fabrics is known in the sector with the term "fastness".

It is therefore evident that the methods and compounds with which textile fibers can be colored differ from fiber to fiber. In fact, depending on the chemical nature of the fiber, the types of chemical bonds to be formed between the surface of the fiber and the dye molecule change, and in a similar way may change the chemical processes and adjuvants of said processes (fixing agents, mordants, . . . ).

With regards to the dyes used in the textile dyeing sector, they belong to a wide range of compounds that are often harmful and dangerous chemical compounds, and can create serious and not easily solvable problems of environmental pollution in the areas where the textile dyeing plants using them are installed. It follows that said dyes, as well as the residues and waste of the textile processes that contain them, must normally be treated and disposed of according to appropriate procedures after their use, with consequent significant increases in the cost of the process. Equally felt is the need that the dyes used in the textile sector are also non-toxic and non-irritating, to avoid that dyed textile products and articles, once worn, can create problems of sensitization or irritation of the skin, or secondary effects due to accumulation in case of absorption through the skin itself.

To cope with said safety and eco-sustainability needs, agreements have been globally established and standards have been globally defined in recent years which set limits on the use of polluting, toxic or carcinogenic substances. Among these standards the most important ones are GB 18401-2010 (in force since 2012), which simultaneously sets minimum limits of fastness and maximum levels of some components used in the process (in particular formaldehyde); the Global Organic Textile Standard 5.0 of 2017 (GOTS 5.0); and the requests from the recent ZDHC (Zero Discharge of Hazardous Chemicals) programme.

These considerations limit the freedom of choice of dyes for each specific textile application.

The need for greater environmental sustainability and of a significant reduction in the current important costs of treatment and disposal of polluting coloring substances is particularly felt in the wool dyeing sector (in the form of yarns, fabrics, or finished clothing articles) in consideration of the importance it has in the textile industry.

In consideration of the needs mentioned above, in recent years the world of textile dyeing has turned to the evaluation of the use of coloring substances of natural origin.

The dyeing of textile fibers with natural dyes is the object of various patent publications.

Patent application CN 104988711 A describes the use of a pigment extracted from red sorghum for the coloring of aramid fibers (synthetic fibers of the polyamide type); the procedure described requires that the fiber be pretreated in a gaseous plasma for the functionalization of the surface.

Patent applications CN 109652998 A, CN 104988713 A and CN 109577031 A relate to the coloring of cotton with pigments extracted from natural substances, in particular cochineal red obtained from the carapace of the homonymous insect, or pigments extracted from various plants; the second one of said applications provides for the pretreatment of cotton fibers in plasma.

As mentioned above, the coloring of animal fibers, and in particular of wool, requires processes and reagents different from those used for synthetic or vegetable fibers.

The coloring of said fibers with natural pigments is described in various documents.

Patent application CN 107558261 A reports the coloring of wool with a relatively complex system, which uses as a dye a mixture of pigments extracted from the pomegranate peel, stabilized on the fiber by a shellac modified by fermentation in contact with sewage sludge from urban or industrial waste. The metal ions present in the sludge form complexes inside the modified shellac, and contribute to the fixing of the color, while the shellac forms a protective and antioxidant layer that improves the fastness thereof. The coloring system of this document is however relatively complex and also does not give guarantees on the control of the components (in particular metal ions) contained therein, and therefore on the fact that the so colored wool is not irritating to the skin.

Patent application CN 105088831 A describes the coloring of wool with shellac red. In the method of this document formaldehyde is used for the pretreatment of wool and a metal-based mordant (aluminum sulphate) are used; formaldehyde is a compound whose use is prohibited by the GOTS 5.0 standard, since the mutagenic and carcinogenic potential properties thereof have now been definitively ascertained.

Patent application CN 108560284 A describes the coloring of a mercerized wool-cotton blended fabric with a natural pigment extracted from the pomegranate peel, using neodymium chloride or alum as a mordant.

Finally, patent application CN 104894890 A describes the coloring of wool or silk with lutein, extracted from plants or flowers such as spinach, carrots, and marigold.

These natural dyes extracted from plants give rise to non-optimal fastness; the inventors believe that this is due to the interference in the coloring process of the substances contained in the natural extracts, but that are not the compound or compounds (pigments) which provide the textile material with the color. Furthermore, the dyes for wool (or fibers or fabrics containing wool) of the prior art reported above all give colors that vary between yellow, orange and red (depending on the dye, the concentration and other parameters such as the pH in the coloring bath), and it is therefore not possible to obtain the whole range of colors required in the textile industry with them. Finally, almost all the coloring processes described use metal-based mordants, which can give rise to sensitization phenomena following prolonged contact with the skin. None of the processes of the prior art is therefore able to meet all the standards recently approved internationally with regard to the eco-compatibility of the processes of the textile industry, i.e. GOTS 5.0, GB 18401-2010 and ZDHC.

The object of the present invention is to provide a dyeing process for the coloring of fibers formed of animal hair, and in particular for the coloring of wool, by using purified coloring substances of synthetic origin for food use. These dyes respond to the stringent regulatory characteristics established by state or supranational authorities, such as FDA in the USA and the European Food Safety Authority in Europe, in the latter case through the "Directive on Colors" 94/36/EC; it follows therefore that the same have no problems in overcoming the downsides of the dyes of the prior art from the point of view of eco-sustainability, reducing the risks of pollution presented by known dyeing treatments (and the installation costs necessary to avoid these risks), providing a product that is non-toxic and hypoallergenic both in contact with the skin and with saliva, and satisfying the demands of fastness of the market that cannot be met with natural dyes.

SUMMARY OF THE INVENTION

The aforesaid objects are achieved with a process for dyeing a textile material, product or article consisting of animal fibers, and in particular for dyeing wool, which includes the operation of coloring said textile material, product or article with a synthetic coloring substance approved for use in the food industry.

In more detail, the invention relates to a process for dyeing a textile material, product or article consisting of animal hair, comprising the following steps:

1) dipping the textile material, product or article for a period between 5 and 15 minutes into a water-based dyeing bath having a temperature between 20 and 30° C., said bath comprising at least:
   a detergent substance;
   a wetting substance;
   a leveling substance;
   an acidity regulator;
2) adding to the dyeing bath of step 1 a synthetic coloring substance approved for use in the food industry, bringing the bath to a temperature between 80 and 120° C. in a time between 50 and 80 minutes, leaving it at this temperature for a time between 30 and 90 minutes, and finally cooling the bath to a temperature between 60 and 80° C. in a time between 10 and 30 minutes;
3) draining the bath and subjecting the textile material, product or article dyed in the previous passages to a first wash in the same machine at a temperature between 35 and 55° C. for a time between 5 and 15 minutes;
4) draining the bath of the first wash and subjecting the textile material, product or article to a second wash in the same machine at a temperature between 20 and 35° C. for a time between 2 and 10 minutes in water, or at 50° C. for a time between 2 and 10 minutes in a solution of sodium acetate in water;
5) draining the bath of the second wash and subjecting the textile material, product or article to a color fixing treatment in a bath containing a fixing substance with a percentage between 1% and 6% with respect to the initial weight of the textile material, product or article at a temperature between 20 and 60° C., for a time between 5 and 30 minutes, and at a pH between 4.5 and 6.5;
6) draining the bath and subjecting the textile material, product or article to drying.

Particular embodiments of the textile dyeing process, conforming to the present invention, are also defined by the dependent claims.

BRIEF DESCRIPTION OF THE DRAWINGS

FIG. 1 reproduces a time diagram which schematically represents a characteristic textile dyeing process of the invention.

DETAILED DESCRIPTION OF THE INVENTION

In the following description of the textile dyeing process of the invention, the reference to a respective and specific embodiment and/or application does not exclude that a particular configuration, structure or characteristic described in relation to this embodiment and application can be included also in other embodiments and applications of the process, in which for reasons of brevity it has not been described. This implies that particular configurations and/or characteristics of the dyeing process of the invention can be combined in any suitable and coherent way in one or more embodiments and applications.

The process of the invention is applied to textile fibers formed from animal fibers. Studies carried out by the inventors have shown that the process of the invention is not effective, for example, for dyeing silk, even if this yarn is in turn of animal origin. This observation confirms what has been said previously, namely that not all processes and not all substances are suitable for coloring all fibers, and that dyes known and used with some fibers (for example, on vegetable fibers such as cotton) are not necessarily usable for coloring fibers derived from animal hair, in particular wool.

In the rest of the text and claims, the following conventions and definitions are adopted:

"synthetic food color" means a dye made through chemical synthesis, and normally used in the food industry to color foodstuffs and beverages;

"textile product" means an animal textile fiber, in particular wool, or any article made with said fiber, therefore the loose fiber, the fiber in yarn, a fabric made with the yarn, or a finished item of clothing made with said yarn or fabric;

all the percentages of the various components used in the process are to be understood by weight relative to the initial weight of the textile product to be colored;

finally, the exact chemical and/or commercial name will be given of all the substances used in the process of the invention; in addition, in order to provide information that is as complete and accurate as possible, the CAS (Chemical Abstract Service) register number is also indicated for the used substances.

The textile dyeing process of the invention comprises a first part, indicated hereinafter also as BT part, in which the textile product to be dyed is dipped and treated in a dyeing bath, and a second part, indicated hereinafter also as TF part, in which the textile product is subjected to a finishing treatment. The bath of the process is water based, i.e. the liquid phase into which the textile product is dipped and the compounds that perform the functions of the various steps (detergents, wetting agents, dyes, . . . ) are dissolved, is water.

All steps of the process of the invention are carried out under stirring. The products used in the process are generally dissolved in water in a separate tank and sent to the dyeing machine by means of a circulation pump which keeps the bath under stirring throughout the process.

All steps of the process take place in water, with a weight ratio between water and the textile product to be dyed which can vary between 10:1 and 40:1; these quantities of water are sufficient to completely solubilize all the chemical compounds (detergents, wetting agents, dyes, . . . ) used in the process.

The process of the invention comprises a preliminary step (also referred to hereinafter as step 0), which consists in leaving the textile product to be colored dipped into water at a temperature between 20 and 30° C. for a time between 5 and 10 minutes. This preliminary step has the purpose of completely impregnating the fibers with water, so that the components of the bath added subsequently can effectively and quickly contact the textile fibers.

The actual process (BT part) begins with step 1 in which, maintaining the temperature between 20 and 30° C., at least one detergent substance, a wetting substance, a leveling substance and an acidity regulator are added to the bath. Said substances essentially have the function of preparing the bath for dyeing the textile product; said substances are known to those skilled in the art, as well as their effects on fibers, and comprise at least:

a detergent substance (which also acts as an emulsifier) having the function of cleaning the textile product so as to prepare it to be dyed in the same dyeing bath; the detergent substance can be for example 2,2-dimethyl-1,3-propanediol (CAS no. 126-30-7);

a wetting substance having the function of deaerating the textile product; the wetting substance can be, for example, polyethylene glycol-10 propyl ether (general formula $((C_2H_4O)_nC_{10}H_{22}O$, CAS no. 160875-66-1), petroleum distillate (CAS No. 64742-47-8), undecyl alcohol ethoxylates (CAS No. 127036-24-2) or a mixture of 2-methyl-3(2H)-isothiazolone and 5-chloro-2-methyl-3(2H)-isothiazolone (CAS no. 55965-84-9);

a leveling substance having the function of leveling the characteristics of the textile product so as to prepare it to be dyed homogeneously; the leveling substance can be for example 5-sulfosalicylic acid (CAS no. 97-05-2), polyethoxylated tallow amines (CAS no. 61791-26-2), quaternary salts of polyethoxylated tallow amines with diethylsulphate (CAS no. 68071-95-4) or a mixture of C16-C18 ethoxylated unsaturated alcohols (CAS no. 68920-66-1); and an acidity regulator, which consists of a mixture of citric acid (CAS no. 77-92-2) and 5-sulfosalicylic acid (CAS no. 97-05-2), which has the function of maintaining the pH constant during the treatment; the weight ratio between citric acid and 5-sulfosalicylic acid can vary between 4:1 and 9:1.

The following table summarizes the substances that are added in step 1 in the dyeing bath and shows the indicative percentages of said substances in the bath with respect to the weight of the textile product to be dyed.

| SUBSTANCE | Percentage (%) |
|---|---|
| Detergent | 1 |
| Wetting agent | 1 |
| Leveling agent | 1-2 |
| pH regulator | 10-30 |

Step 1 of the process lasts between 5 and 15 minutes.

In a variant of the process, the wetting substance can be added in step 0 described above, or in part in step 0 and the remaining part in step 1.

Subsequently, at the beginning of step 2 of the process, a purified synthetic food color is added to the dyeing bath, according to a salient feature of the dyeing process of the invention. The synthetic coloring substances for food use that can be used in the invention are shown in the following table, in which a chemical or commercial name, the GAS number, the code with which this is designated in the European Union (when available) and the color that the substance gives to the textile product, are indicated for each substance:

| Commercial name | CAS No. | Code | Color |
|---|---|---|---|
| Tartrazine - Acid yellow 23 | 1934-21-0 | E102 | Yellow |
| Quinoline yellow | 8004-92-0 | E104 | Yellow |
| Sunset yellow | 2783-94-0 | E110 | Yellow-orange |
| Food red 3 | 3567-69-9 | E122 | Carmine |
| Amaranth red - Acid red 27 | 915-67-3 | E123 | Amaranth red |
| Acid red 18 | 2611-82-7 | E124 | Red |
| Erythrosine B - Acid red 51 | 16423-68-0 | E127 | Red |
| Food red 17 | 25956-17-6 | E129 | Scarlet red |
| Food blue 5:2 | 20262-76-4 | E131 | Blue |
| Acid blue 74 | 860-22-0 | E132 | Blue |

-continued

| Commercial name | CAS No. | Code | Color |
|---|---|---|---|
| Erioglaucine disodium salt - Food blue 2 | 3844-45-9 | E133 | Blue |
| Lissamine green B - Acid green 50 | 3087-16-9 | E142 | Green |
| Food black 1 | 2519-30-4 | E151 | Black |
| Chocolate brown HT | 4553-89-3 | E155 | Brown |

Each of said coloring substances can be used alone, or it is possible to use a mixture of two or more of these substances to obtain particular shades of color; both in the case of a single substance and in the case of a mixture of two or more of these coloring substances, the percentage in the dyeing bath of this component can vary between 0.001% and 6%. Within this range, the actual quantity to be used can be determined using methods and techniques known to the experts in the sector, according to the desired result (for example, the intensity of color or the tone to be obtained).

For example, it is possible, through a common laboratory textile dyeing machine, to prepare a plurality of recipes, that is a plurality of dyeing baths having different percentages, even slightly, of said synthetic food color and then test them to verify their real effect on the textile product to be dyed, in order to select the recipe or the dyeing bath with the percentage of synthetic food coloring substance that provides the best result as regards the dyeing of the textile product.

Simultaneously with the introduction of the synthetic food color in the desired percentage into the dyeing bath, the temperature of the latter is gradually increased, in a time between 50 and 80 minutes, preferably 70 minutes, from the initial temperature, for example 30° C., to a temperature between 80 and 120° C., preferably of about 100° C. After reaching the desired temperature, the bath is left at this temperature for a time between 30 and 90 minutes, preferably 60 minutes, and finally it is cooled to a temperature between 60 and 80° C., preferably to 70° C.; cooling generally requires a time between 10 and 30 minutes, typically about 15 minutes.

After being treated and dyed in the dyeing bath, the textile product is subjected to a finishing treatment, indicated as a whole with TF, comprising various steps and interventions. This part can be started immediately after the conclusion of the BT part or later.

In particular, after having reached 70° C. of the dyeing bath with cooling, the bath is drained to perform a first wash in water of the dyed textile product, corresponding to step 3 of the process of the invention. Said first wash is preferably carried out in the same machine in which the dyeing took place, at a temperature between 35 and 55° C., preferably 40° C., for a time between 5 and 15 minutes, preferably for 10 minutes, after which the bath of the first wash is drained from the machine.

Then, the textile product is subjected, preferably in the same machine of the first wash, to a second wash, corresponding to step 4 of the process of the invention; said wash can take place in water at a temperature between 20 and 35° C., preferably at 30° C., for a time between 2 and 10 minutes, preferably for 5 minutes; alternatively, the second wash can be done at a temperature of 50° C. for a time between 2 and 10 minutes, preferably for 5 minutes, in an aqueous solution containing 5% by weight (with respect to the textile product) of sodium acetate. After the conclusion of this step, the bath of the second wash is drained from the machine.

In step 5 of the process of the invention, the dyed textile product is subjected to a color fixing treatment. Said treatment consists in dipping the textile product (in the same machine of the washing baths or in another machine) into a bath containing a fixing substance in a percentage between 1% and 6% by weight with respect to the initial textile product, at a temperature between 20 and 60° C., preferably at 40° C., for a time between 5 and 30 minutes, preferably 20 minutes, at a pH between 4.5 and 6.5, preferably 5.5. This treatment has the function of increasing wet fastness, the resistance of the textile product to pilling, and also conferring water repellency to the final textile product. Alternatively, the fixing substance can be applied in "foulard mode" (impregnation followed by squeezing and drying) if the textile product is a fabric; or by spraying distribution, particularly suitable when the textile product to be treated is an already finished item of clothing. The fixing substance is diethylene glycol, a 5% suspension of silica in water, or a mixture thereof. The silica gel having the desired concentrations can be produced by suspending in water the product known as "nanometric silica", "colloidal silica" or "fumed silica"; said form of silica is widely available commercially and is sold for example by the company Evonik Resource Efficiency GmbH of Essen (Germany) under the name AEROSIL®, or by the company Cabot Corporation of Boston, Massachusetts (USA) under the name Cab-O-Sil®.

At the end of the fixing treatment, in step 6 of the process the bath is drained, and the textile product is sent for drying in view of any subsequent treatments.

FIG. 1 represents a time diagram which schematically shows the time/temperature profile of a typical dyeing process according to the invention, which is reported by way of example. As shown in the FIGURE, the process consists of a first BT part (in which the textile product is colored) and a second TF part (finishing treatments, in which the color is fixed). Each of the steps of the process (including the preliminary step 0) is indicated with the corresponding number in the lower part of the diagram (near the time axis).

In the process of the example in FIG. 1, the preliminary step 0 (impregnation of the textile product with water) and step 1 (addition of detergent, wetting agent, leveling agent and acidity regulator) are both carried out at 30° C., each with a duration of 5 minutes. The actual dyeing step, 2, which begins with the addition of the chosen dye to the bath, comprises a first part of increasing the temperature from 30° C. to 100° C. in 70 minutes, holding the bath containing the textile product at 100° C. for 60 minutes, cooling from 100° C. to 70° C. in 15 minutes and subsequent cooling to temperatures around room temperature.

There is no fixed temporal relationship between the end of the BT part and the beginning of the TF part of the process: this condition is represented by the broken axis of times between these two parts of the process.

The TF part of the process starts at the minute zero of this part, with step 3 (first wash) which is carried out at 40° C. for a time of 10 minutes, followed by a step 4 (second wash) carried out at 30° C. for 5 minutes, and subsequently by the color fixing step 5, which is carried out at 40° C. for 20 minutes. Step 6 (drain of the finished textile product from the last bath and subsequent operations) has no precise temperature and duration.

As said, the one represented in FIG. 1 is only one possible example of the process of the invention; as will be evident to the person skilled in the art, each of the steps represented in the FIGURE and described in detail below could be carried out at a temperature or for a duration of time different from those indicated in the FIGURE, provided that these temperatures and durations fall within the ranges previously reported; in particular, remaining within said intervals, the duration of each of the steps of the process will generally be the shorter, the higher the temperature at which it is carried out, and vice versa.

The process of the invention can also admit other variations, modifications and improvements with respect to what has been described and illustrated so far.

For example, without prejudice to the use, for preparing the BT dyeing bath, of a purified synthetic dye already used in the food sector, which use corresponds to the salient feature of the invention, the other conventional substances, included in the BT dyeing bath and used in the TF finishing treatment of the textile product, may vary with respect to those previously described and illustrated with reference to the dyeing process, in particular as a function of the specific characteristics that the textile product, once dyed, must satisfy.

The invention will be further described by the following examples.

Example 1

Six samples of wool fabric are colored according to processes of the invention and according to processes not of the invention. The samples obtained in preparations 1A, 1B, 2A and 2B have been produced with processes that do not satisfy the conditions of the invention, and are therefore comparative samples; the samples 1C and 2C are instead samples obtained according to the process of the invention.

To allow the comparison of the results, the thermal profile (temperature/time) adopted in the preparation process is the same for all six samples and corresponds to the thermal profile described above with reference to FIG. 1. The components adopted in the various steps of the process for the six samples are shown in Table 1. The components used in each of the tests are identified with the CAS number apart from silica which is indicated by its formula $SiO_2$. Sodium sulphate and formic acid are used in the comparison tests as they are typical components of dyeing baths of the prior art. For each of the components used, the table shows the quantity used (in % by weight on the weight of the sample of the colored wool fabric).

TABLE 1

| | Preparation or sample | | | | | |
|---|---|---|---|---|---|---|
| Component | 1A | 1B | 1C | 2A | 2B | 2C |
| CAS 1934-21-0 non-food dye | 0.3 | / | / | 0.25 | / | / |
| CAS 2611-82-7 non-food dye | 0.3 | / | / | 0.2 | / | / |
| CAS 3844-45-9 non-food dye | 0.3 | / | / | / | / | / |
| 2519-30-4 non-food dye | / | / | / | 0.6 | / | / |
| CAS 1934-21-0 food dye | / | 0.3 | 0.3 | / | 0.25 | 0.25 |
| CAS 2611-82-7 food dye | / | 0.3 | 0.3 | / | 0.2 | 0.2 |
| CAS 3844-45-9 2 food dye | / | 0.3 | 0.3 | / | / | / |
| 2519-30-4 food dye | / | / | / | / | 0.6 | 0.6 |
| Wetting agent (CAS 55965-84-9) | 1 | 1 | 1 | 1 | 1 | 1 |
| Detergent (CAS 126-30-7) | / | / | 1 | / | / | 1 |
| Leveling agent (CAS 61791-26-2) | 1 | 1 | / | 1 | 1 | / |
| Leveling agent (CAS 61791-26-2 + CAS 97-05-2) | / | / | 1 | / | / | 1 |
| Sodium sulphate (CAS 14808-79-8) | 5 | 5 | / | 5 | 5 | / |
| Formic acid (CAS 64-18-6) | 4 | 4 | / | 4 | 4 | / |
| PH regulator (CAS 77-92-9 + CAS 97-05-2 + CAS 64-18-6) | / | / | 20 | / | / | 20 |
| Fixing agent (CAS 111-46-6 + $SiO_2$) | / | / | 5 | / | / | 5 |

Example 2

The six samples obtained in Example 1 are subjected to a color release test according to the UNI EN ISO 105-E04 standard test, which is the most severe and selective test to pass the GB 18401 standard; according to this standard, the test simulates the release of color by a fabric in the presence of alkaline perspiration (alkaline perspiration is simulated with a basic solution sold specifically for carrying out said test).

The test is carried out by impregnating each sample with the diluted soda solution and then placing the sample in contact with a "witness fabric", that is, a strip of fabric made with six different materials (acetate, cotton, polyamide, polyester, acrylic and wool), and by evaluating the intensity of the color acquired by the various parts of the witness through release from the sample under examination; the more intense the staining of the witness, the greater the release from the examined tissue and therefore the worse the result is considered. The values are reported to a grey scale with values varying between 1 and 5, in which the lower the value, the poorer the fastness. GB 18401 accepts 3-4 as a minimum dye-fading value.

The results of the tests carried out on the six samples 1A, 1B, 1C, 2A, 2B and 2C are shown in Table 2.

TABLE 2

| Witness fabric | 1A | 1B | 1C | 2A | 2B | 2C |
|---|---|---|---|---|---|---|
| Acetate | 4-5 | 4-5 | 5 | 4-5 | 4-5 | 5 |
| Cotton | 2 | 2 | 5 | 1-2 | 1-2 | 5 |
| Polyamide | 2 | 2 | 4 | 2-3 | 2-3 | 4-5 |
| Polyester | 4 | 4 | 5 | 4 | 4 | 5 |
| Acrylic | 4 | 4 | 5 | 4 | 4 | 5 |
| Wool | 2 | 2 | 3-4 | 2 | 2 | 4 |

From the results of the tests reported in Table 2 it can be deduced that purified synthetic dyes for food use applied in the textile field to dye the protein fibers, if used with the known process (samples 1B and 2B) would only have the advantage of being eco-sustainable compared to the same not purified dyes (samples 1A and 2A); on the other hand, if applied with the process of the invention (samples 1C and 2C) in addition to eco-sustainability, the purified synthetic dyes for food use also allow excellent wet color fastness to be obtained.

Comments

The new textile dyeing process of the invention, which uses purified synthetic dyes approved for the food industry, allows to fully achieve the set objectives and in particular provides both a new innovative textile dyeing process capable of eliminating all the negative effects connected to the use, in conventional textile dyeing, of synthetic and natural dyes, and also a new and innovative use of purified dyes of synthetic origin which are usually and currently used in the food industry.

This process offers a series of relevant and unique advantages, some of which have already been illustrated above, among which the following ones can be mentioned:

- the dyes used in the textile dyeing process, being synthetic but purified, do not feature any toxicity or harmfulness to the operators and workers who manage the textile dyeing processes and plants in which said dyes are used;
- in particular, the purified synthetic dyes used are metal-free, do not contain allergenic substances, are not mutagenic, and the respective powders do not contain any type of free amines or other substances harmful to the health of the operators who must handle said dyes;
- the process allows a significant reduction of the costs for treating and disposing of the residues and waste produced by the textile dyeing, since the dyes used are free of polluting substances;
- there are better and healthier working conditions in textile dyeing plants;
- the dyeing costs of textile products and/or articles are competitive with those of the conventional textile dyeing processes, that is, using conventional dyes;
- the textile products colored with the process of the invention meet the GB18401, GOTS 5.0 standards and the requirements of the ZDHC programme.

The invention claimed is:

1. A textile dyeing process for dyeing a textile material, product or article of fibers and fabrics consisting of animal hair, comprising the following steps, wherein steps 1) to 5) take place under stirring:

1) dipping the textile material, product or article for a period between 5 and 15 minutes into a water-based dyeing bath having a temperature between 20 and 30° C., said bath comprising at least:
   - 2,2-dimethyl-1,3-propanediol (CAS no. 126-30-7) as a detergent substance;
   - a wetting substance selected from polyethylene glycol-10 propyl ether ($(C_2H_4O)_nC_{10}H_{22}O$, CAS no. 160875-66-1), petroleum distillate (CAS No. 64742-47-8), undecyl alcohol ethoxylates (CAS No. 127036-24-2) and a mixture of 2-methyl-3(2H)-isothiazolone and 5-chloro-2-methyl-3(2H)-isothiazolone (CAS no. 55965-84-9);
   - a leveling substance selected from 5-sulfosalicylic acid (CAS no. 97-05-2), polyethoxylated tallow amines (CAS no. 61791-26-2), quaternary salts of polyethoxylated tallow amines with diethylsulphate (CAS no. 68071-95-4) and a mixture of C16-C18 ethoxylated unsaturated alcohols (CAS no. 68920-66-1);
   - an acidity regulator consisting of a mixture of citric acid (CAS no. 77-92-2) and 5-sulfosalicylic acid (CAS no. 97-05-2), in a weight ratio between citric acid and 5-sulfosalicylic acid between 4:1 and 9:1;
2) adding to the dyeing bath of step 1 one or more synthetic coloring substances, bringing the bath to a temperature between 80 and 120° C. in a time between 50 and 80 minutes, leaving it at this temperature for a time between 30 and 90 minutes, and finally cooling the bath to a temperature between 60 and 80° C. in a time between 10 and 30 minutes;
3) draining the bath and subjecting the textile material, product or article dyed in the previous passages to a first wash in the same machine at a temperature between 35 and 55° C. for a time between 5 and 15 minutes;
4) draining the bath of the first wash and subjecting the textile material, product or article to a second wash in the same machine at a temperature between 20 and 35° C. for a time between 2 and 10 minutes in water, or at 50° C. for a time between 2 and 10 minutes in a solution of sodium acetate in water;
5) draining the bath of the second wash and subjecting the textile material, product or article to a color fixing treatment in a bath containing a fixing substance with a percentage between 1% and 6% with respect to the initial weight of the textile material, product or article at a temperature between 20 and 60° C., for a time between 5 and 30 minutes, and at a pH between 4.5 and 6.5 obtained with a pH regulator consisting of a mixture of citric acid and 5-sulfosalicylic acid in a weight ratio between 4:1 and 9:1, and said fixing substance is selected among diethylene glycol, a 5% suspension of silica in water, or a mixture thereof;
6) draining the bath and subjecting the textile material, product or article to drying.

2. The process according to claim 1, further comprising a preliminary step 0 carried out under stirring, wherein said textile material, product or article to be colored is dipped into water at a temperature between 20 and 30° C. for a time between 5 and 10 minutes, and wherein all or part of the quantity of wetting substance necessary for carrying out step 1 is optionally added to water.

3. The process according to claim 1, wherein the quantities are used, in percentage by weight with respect to the weight of said textile material, product or article, 1% of said detergent substance, 1% of said wetting substance, between 1% and 2% of said leveling substance and between 10 and 30% of said acidity regulator.

4. The process according to claim 1, wherein said one or more synthetic coloring substances are selected from the substances of the following table:

| Commercial name | CAS No. | Code | Color |
|---|---|---|---|
| Tartrazine - Acid yellow 23 | 1934-21-0 | E102 | Yellow |
| Quinoline yellow | 8004-92-0 | E104 | Yellow |
| Sunset yellow | 2783-94-0 | E110 | Yellow-orange |
| Food red 3 | 3567-69-9 | E122 | Carmine |
| Acid red 18 | 2611-82-7 | E124 | Red |
| Erythrosine B - Acid red 51 | 16423-68-0 | E127 | Red |
| Food red 17 | 25956-17-6 | E129 | Scarlet red |
| Amaranth red - Acid red 27 | 915-67-3 | E123 | Amaranth red |
| Food blue 5:2 | 20262-76-4 | E131 | Blue |
| Acid blue 74 | 860-22-0 | E132 | Blue |
| Erioglaucine disodium salt - Food blue 2 | 3844-45-9 | E133 | Blue |
| Lissamine green B - Acid green 50 | 3087-16-9 | E142 | Green |

-continued

| Commercial name | CAS No. | Code | Color |
|---|---|---|---|
| Food black 1 | 2519-30-4 | E151 | Black |
| Chocolate brown HT | 4553-89-3 | E155 | Brown |

5. The process according to claim 1, wherein said one or more synthetic coloring substances are used in a quantity between 0.001% and 6% of the weight of the textile product.

6. The process according to claim 1, wherein said step 5 is carried out by dipping said textile material, product or article into the bath containing the fixing substance, or with the "foulard" technique when said textile material, product or article is a fabric, or with a spray technique when said textile material, product or article is a finished item of clothing.

7. The process according to claim 1, wherein said textile material, product or article is made of wool.

8. A textile material, product or article consisting of animal hair textile fibers, dyed with the textile process according to claim 1.

* * * * *